United States Patent [19]

Beyer

[11] Patent Number: 5,022,158

[45] Date of Patent: Jun. 11, 1991

[54] WALL MARKING LAYOUT DEVICE

[76] Inventor: Bruce R. Beyer, 451 Aldine St., St. Paul, Minn. 55104

[21] Appl. No.: 516,545

[22] Filed: Apr. 30, 1990

Related U.S. Application Data

[63] Continuation-in-part of Ser. No. 358,253, Mar. 30, 1989, Pat. No. 4,921,507.

[51] Int. Cl.[5] ..... B44D 3/38; B43L 7/00

[52] U.S. Cl. ..... 33/413; 33/1 LE; 33/414

[58] Field of Search ..... 33/413, 414, 756, 1 LE, 33/339, 392

[56] References Cited

U.S. PATENT DOCUMENTS 3,122,836 3/1964 Aciego ..... 33/413

3,145,477 8/1964 Morrison ..... 33/DIG. 1

3,662,471 5/1972 Lynde ..... 33/770

FOREIGN PATENT DOCUMENTS 2370955 7/1978 France ..... 33/392

*Primary Examiner*—Harry N. Haroian

[57] ABSTRACT

A layout tool includes an elongate rectangular shaped body having opposed upper and lower surfaces, opposed end surfaces and opposed front and rear surfaces. The layout tool is formed of a dense material and has a U-shaped handle detachably secured thereto and projecting upwardly therefrom. Anchoring pins are adjustably secured to the body to permit vertical adjustment thereof. Positioning grooves on the front, end and lower surfaces of the body to permit positioning of the chalk line during the layout operation.

5 Claims, 1 Drawing Sheet

WALL MARKING LAYOUT DEVICE

BACKGROUND OF THE INVENTION

This invention is a continuation in part application of my co-pending application Ser. No. 358,253, filed Mar. 30, 1989 and entitled Layout Device now U.S. Pat. No. 4,921,507.

FIELD OF THE INVENTION

This invention relates to a layout tool for snapping various types of chalk lines for layout purposes.

SUMMARY OF THE INVENTION

An object of this invention is to provide a novel and improved layout tool comprising a generally rectangular shaped body having a carrying handle secured thereto which is positioned upon a surface and which serves as an anchor for a chalk line to permit a single worker to make layout lines at construction sites and the like.

In carrying out this invention, the layout tool comprises a generally rectangular shaped body formed of a dense metallic material and having an attachment element located at the central portion thereof to which the chalk line is attached. Positioning grooves are formed in the front, end and bottom surfaces of the body for guiding the chalk line during the layout operation. The layout tool is provided with vertically adjustable anchoring pins that project downwardly from the lower surface for penetrating the surface upon which the layout tool is placed. A detachable carrying handle is secured to the body of the tool for conveniently carrying the tool and for placing the tool at the desirable location.

FIGURES OF THE DRAWING

DESCRIPTION OF THE PREFERRED EMBODIMENT

Figure 1:
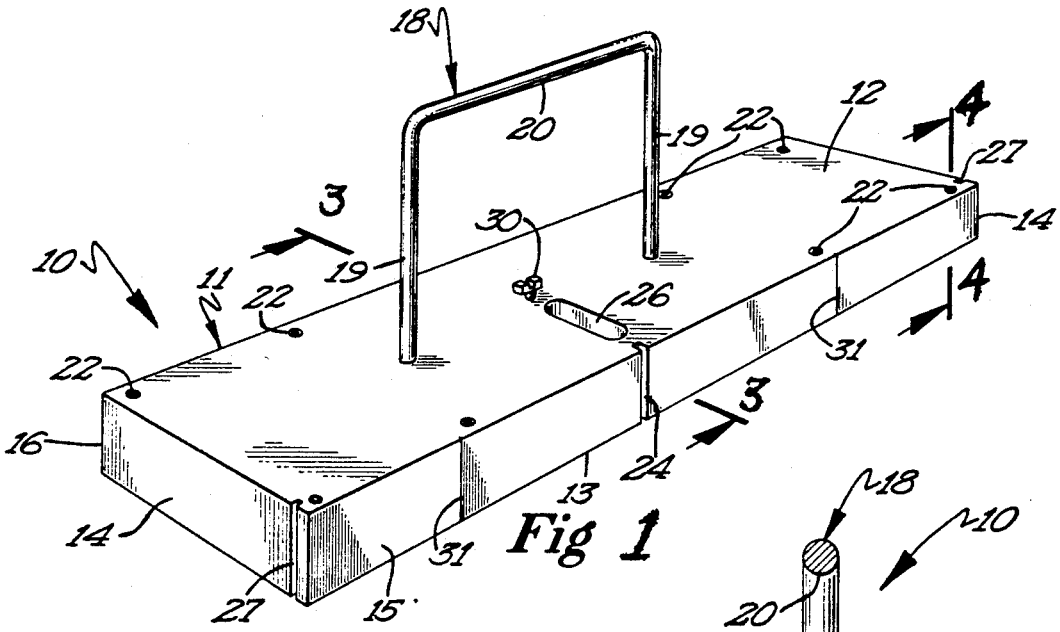
FIG. 1 is a perspective view of the novel tool.
Figure 3:
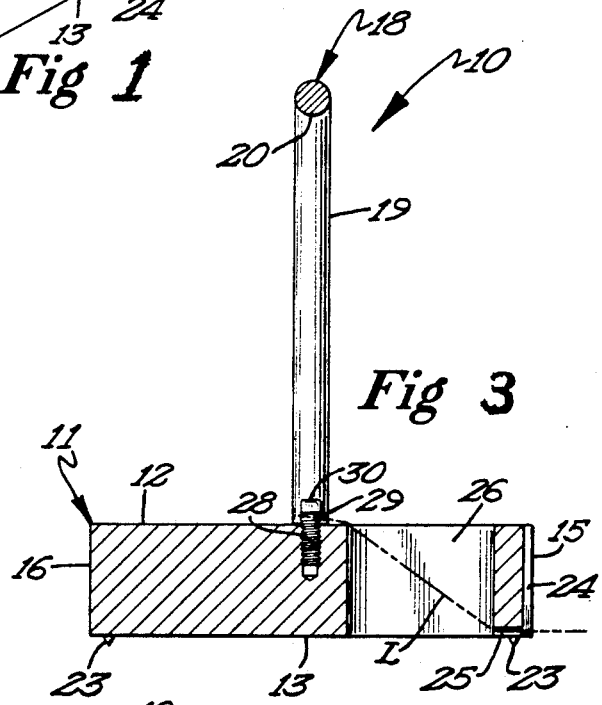
FIG. 3 is a cross-sectional view taken approximately along lines 8—8 of FIG. 1 and looking in the direction of the arrows and, FIG. 4 is a cross-sectional view taken approximately along lines 9—9 of FIG. 1 and looking in the direction of the arrows.
Figure 4:
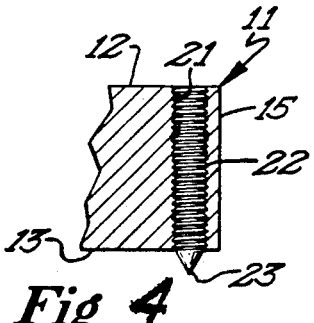
Figure 2:
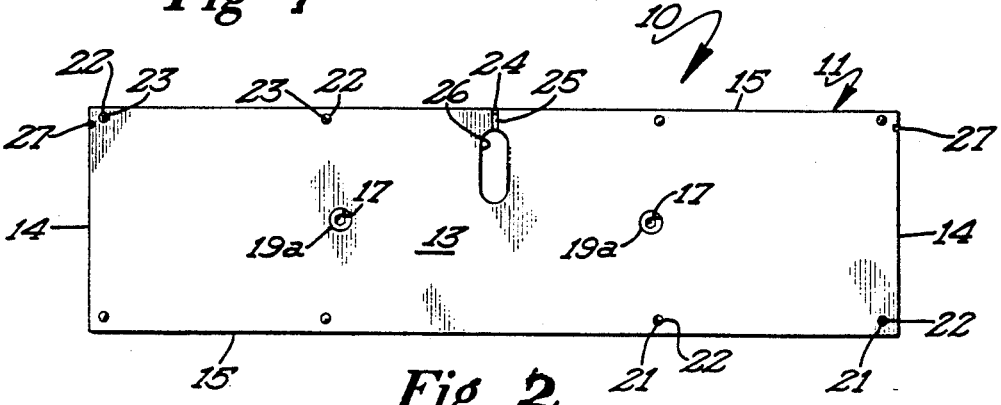
FIG. 2 is a bottom plan view thereof.

Referring now to drawings and more specifically to FIG. 6 it will be seen that one embodiment of the novel layout tool, designated generally by the reference number 10, is thereshown. The layout tool 10 is comprised of an elongate rectangular shaped body 11 formed of a dense metallic material such as steel or the like. Rectangular shaped body 11 has a planar top surface 12, planar bottom surface 13, end surfaces 14, front surface 15, and a rear surface 16. The body 11 is provided with a pair of longitudinally spaced apart openings 17 therethrough which are disposed in the longitudinal vertical center line plane thereof. The openings 17 accommodates a U-shape handle 18 therein.

The U-shaped handle 18 is comprised of a pair of parallel handle legs 19 which are integral with a bight portion 20. The legs 19 project into the openings 17 and are secured therein by Allen-head bolts 19*a* which are threaded into threaded openings in the legs of the U-shaped handle, The bolts 19*a* are recessed into the openings 17. The U-shape handle 18 may be readily removed for shipping to permit packaging of the layout tool in a compact package.

The rectangular shaped body 11 is also provided with a plurality of vertically extending threaded openings 21 therethrough which are located adjacent the front and rear surfaces of the body. It will be noted that the openings along each front and rear surface are longitudinally spaced apart and each opening adjacent one surface is disposed in opposed relation to an opening adjacent the opposite surface. In the embodiment shown, four openings are provided adjacent the front surface and four openings are provided adjacent the rear surface. The openings adjacent each surface are in longitudinal alignment.

Each of these threaded openings accommodates an elongate threaded anchoring pin 22 which has a recessed Allen-head at one end and has a penetrating point 23 at the other end. The anchor pins 22 are each vertically adjustable as desired to accommodate the particular working conditions. It will also be noted that in normal use, the point 23 projects from the lower surface of the body 11 while the upper end of the threaded pin is located closely adjacent the upper surface thereof. This prevents the accumulation of debris and the like into the openings 21.

The front surface 15 has a vertical groove 24 therein while the bottom surface 13 has a transverse groove 25 therein which communicates with the vertical groove 24. The body 11 also has an elongate transversely extending opening 26 therethrough. It is pointed out that the vertical groove 24 and the transverse groove 25 are located in the transverse vertical center line plane of the body 11. Each of the end surfaces 14 has a vertical end groove 27 therein. These end grooves 27 are longitudinally alined and are located closely adjacent the front surface 15 of the body 11. It will be seen that the transverse groove 25 communicates with the opening 26.

An upwardly opening threaded recess 28 is located in the body 11 and accommodates a bolt 29 having a head 30. This bolt 29 comprises an attachment element for attachment of one end of the chalk line L. The attachment element is also located in the transverse vertical center line plane of the body and is disposed in transverse alignment with the vertical groove 24 and the transverse groove 25.

The front surface 15 is provided with a pair of longitudinally spaced apart vertical indicia lines 31, each being located between the vertical groove 24 and one of the end surfaces 14. The spacing between the vertical groove 24 end one indicia line 31 is equal in length to the spacing between the vertical groove and the other indicia line In the embodiment shown, the spacing between the vertical groove 24 and each indicia line 31 is three and half inches. The spacing between each vertical line indicia 31 and the adjacent end surface 14 is two inches. The length of the body is eleven inches while its width is three inches.

The layout tool will be used in the same manner and for the same purposes as that described in my co-pending application Ser. No. 358,253. One end of the chalk line or dry line will be secured to the attachment element 29 and the line will be passed through the opening 26 and typically through the transverse groove 25. Although not shown in the drawings, a conventional chalk line mechanism will be provided.

When the layout tool 10 is to be used to locate an outside wall or an inside wall of a building, the user will position the layout tool so that the central vertical groove 24 or one of the indicia lines 31 is aligned with a reference line. The body 11 will be positioned so that the front surface 15 faces the direction of the chalk line to be snapped. For example, in locating an outside wall, the body 11 may be positioned so that the vertical groove 24 is disposed on the reference line at the 5½ inch indicia. The vertical groove 24 is located 5½ inches from each end wall.

Typically, the body may be positioned on the reference line at the 3½ inch designation in locating an inside wall. The line indicia 31 are each located 3½ inches from the vertical groove 24. The user will then produce the layout lines in the same manner of use as the layout tool disclosed in my co-pending application Ser. No. 358,253.

The layout tool may also be used to mark vertical layout lines by extending the layout string or cord along the lower surface of the bottom wall 13 until the string engages in one of the vertical grooves 27. The string may then be pulled upwardly through a vertical groove 27 until the correct vertical distance is reached and the point located. The user will then snap the line on an existing vertical surface to locate a layout line. A vertical line may also be located by positioning the line upwardly through the vertical groove 24 in the front surface 15. With this arrangement, a single user can provide layout lines for the layout on vertical walls and on arches in walls. Again, it will be noted that the single user is not required to drive nails in making vertical layout lines, as required in the conventional practice.

In scribing layout circles, the user will place the vertical groove 24 at the center of the circle to be scribed and along the line passing through the center. The string will then be unwound until the correct radius is reached.

After determining the correct radius, the user may then scribe a semi-circle, using a pencil or other marking device, and using the selected radius. The body 11 may then be repositioned on the same point and on the same semi-circular diameter, but with the body facing in the opposite direction (rotating the body 11 through an arc of 180 degrees from its original position). The selected radius will then again be marked, forming the matching semi-circle.

The layout tool 10 is also used in dry line work where actual measurements are made along the cord or string rather than using the string to make a layout chalk line. The pointed lower end of each anchoring pin may be inserted into a surface, including asphalt, concrete, wood, or the like, to stabilize the tool against movement when a substantial pulling force is exerted by the string during dry line work. The anchoring pins may be retracted after dry line wall is completed.

It will therefore be seen that I have provided a novel layout tool which is not of simple and inexpensive construction but one which functions in a more efficient manner than by heretofore known comparable tool.

What I claimed is:

1. A layout tool for snapping various types of layout chalk lines on a work area surface, such as construction sites or the like, comprising an elongate, generally rectangular shaped body formed of a dense material and including a substantially flat lower surface, front surface, rear surface, opposed end surfaces and an upper surface, said front surface having a vertical groove therein extending through the transverse vertical center line plane of the body, a U-shaped handle, means detachably securing said handle to said body whereby said handle projects upwardly from said body, a plurality of anchoring pins adjustably secured to said body and projecting downwardly therefrom, each of said anchoring pins having a pointed lower end and being vertically adjustable relative to said body and penetrating the surface upon which the body is positioned, an attachment element on the upper surface of said body adjacent the transverse center line plane thereof for anchoring one end of a chalk line, an opening through the body located between the attachment element and said vertical groove, and a transverse groove in the lower surface of the body communicating with said vertical groove and said opening and accommodating a chalk line therein which extends from the attachment element through the opening to thereby permit a chalk line to be pulled tight and snapped to form a layout line chalk on the surface of a work area.

2. The layout tool as defined in claim 1 and a pair of line indicia on said front surface, each of said line indicia being spaced from one of said end walls, the spacing between one of said line indicia and the adjacent end wall being equal to the spacing between the other line indicia and the other end wall.

3. The layout tool as defined in claim 1 wherein said body has a plurality of threaded openings therein, each anchoring pin being externally threaded and threadedly engaging in one of said threaded openings to permit selective vertical adjustment of said anchoring pins.

4. The layout tool as defined in claim 1 wherein said U-shaped handle is disposed in the longitudinal vertical center line plane of said body.

5. The layout tool as defined in claim 1 and a pair of vertical end grooves in said body, each end groove being located in one of said end surfaces, said end grooves being disposed in longitudinal alignment and each accommodating a chalk line therein during a layout operation.

* * * * *